United States Patent [19]

Ishida

[11] Patent Number: 4,881,621

[45] Date of Patent: Nov. 21, 1989

[54] SPIRAL SPRING POWER SOURCE FOR TOY

[75] Inventor: Minoru Ishida, Tokyo, Japan

[73] Assignee: Marusan Co., Ltd., Tokyo, Japan

[21] Appl. No.: 198,562

[22] Filed: May 25, 1988

[30] Foreign Application Priority Data

May 30, 1987 [JP] Japan ..... 62-136009

[51] Int. Cl.[4] ..... F03G 1/08

[52] U.S. Cl. ..... 185/39; 185/38; 185/45; 185/DIG. 1; 403/4; 403/289; 446/464

[58] Field of Search ..... 185/37, 38, 39, DIG. 1, 185/45; 446/464; 403/4, 289

[56] References Cited

U.S. PATENT DOCUMENTS

| | | | |
|---|---|---|---|
| 692,783 | 2/1902 | Dyre | 185/39 |
| 1,739,113 | 12/1929 | Azarraga | 185/39 |
| 3,283,855 | 11/1966 | Kaplan | 185/39 |
| 3,995,718 | 12/1976 | Nakamori | 185/39 |
| 4,456,805 | 6/1984 | Jorgensen et al. | 185/39 X |
| 4,715,475 | 12/1987 | Minoru | 185/DIG. 1 |

FOREIGN PATENT DOCUMENTS

| | | | |
|---|---|---|---|
| 784667 | 10/1957 | United Kingdom | 185/39 |

*Primary Examiner*—Allan D. Herrmann

*Attorney, Agent, or Firm*—Fleit, Jacobson, Cohn, Price, Holman & Stern

[57] ABSTRACT

This invention relates to a spiral spring power source for a toy, which can select a method of winding a power spiral spring 7 by a pulling string type winding cord 25 and a method of winding the power spiral spring 7 by a winding key 43 by removing a mechanism relative to the winding yarn 25, can alter the pulling direction of the winding cord 25 at 360° in case of the method with the winding cord 25, can drive the output shaft through a gear set when uncoiling the energized power spiral spring 7, but can produce outputs not at one position but at a plurality of positions to be connected to a plurality of gears selected from the gear set.

5 Claims, 4 Drawing Sheets

SPIRAL SPRING POWER SOURCE FOR TOY

FIELD OF THE INVENTION

This invention relates to a spiral spring power source for a toy and, more particularly, to a spiral spring power source adapted for a prime mover for moving the operating section of a toy of various types.

DESCRIPTION OF THE PRIOR ART

A spiral spring power source for use in a toy, such as a miniature car has a structure as disclosed in Japanese Utility Model Publication No. 30716/1986, and the structure has a spiral spring which is wound up by reversely rotating its output shaft. Another spiral spring power source disclosed in Japanese Patent Publication No. 21633/1984 has a structure that a spiral spring is wound up by normally or reversely rotating its output shaft.

However, the conventional spiral spring power sources have no difference from an old spiral spring type toy in its functions. In other words, one output shaft is merely rotated in the conventional spiral spring power source. Then, the present inventor has developed another types of spiral spring power sources in which the rotating speeds of its output shaft are switched in two steps, one of which was already patented as U.S. Pat. No. 4,715,475.

The spiral spring power source of the patented prior invention has a structure that the rotating speed of its output shaft is slow at the initial time and then accelerated as thus improved from the conventional spiral spring power source which was simple and could not have various values of utility, and thus extended in its utility. However, this spiral spring power source is still the same as the conventional one at the point that its input and output shafts have the same speed.

SUMMARY OF THE INVENTION

An object of this invention is to provide a spiral spring power source for a toy which can alter in its input direction and at the position of its output shaft by partially moving, selecting and replacing its components with a structure that methods of winding up its spiral spring and the modes of its output can be selected by the same fundamental structure.

Another object of this invention is to provide a spiral spring power source for a toy for use as a prime mover for moving the operating section of various types of toys, such as not only moving toys like a miniature car, a walking doll, a ship or a boat, but also a rotary toy like a merry-go-round, or a wooden or die-cast toy, which provides modes of output shaft in a wide range from a low torque and high speed rotation to a high torque and low speed rotation.

The above object of the invention can be achieved by a spiral spring power source for a toy comprising a spiral spring case having a power spiral spring fixed at its outer end thereof to an outer body housing and rotatably mounted, a spiral spring winding shaft projected from the center of the outside of the spiral spring case, a connector formed on the winding shaft for mounting one or more types of winding mechanisms, and a ratchet mechanism provided inside the spiral spring case for connecting the main shaft fixed with the inner end of the power spiral spring to a first gear only at the time of uncoiling the spiral spring.

According to the present invention, one or more types of winding mechanisms can be selectively mounted on the power spiral spring winding shaft and one or more types of governor mechanism can be selectively mounted on an intermediate output shaft to constitute the spiral spring power source. Therefore, several types of toys can be manufactured by modifying the partial section of the toy without altering the main structure, thereby performing effects in response to various requirements of clients. Since various modes of outputs are provided by the same constitution of the power spiral spring, the spiral spring power source can be available for power sources of toys of various types of very wide range to be used as all types of prime movers for toys which employ a battery-powered electric motor as a power source.

DESCRIPTION OF THE PREFERRED EMBODIMENTS

The invention will be described with respect to an embodiment of a spiral spring power source for a toy according to the present invention with reference to the accompanying drawings. The exemplified embodiment has a standard size (65 mm×33 mm×20 mm), and is molded in all components of synthetic resin.

Figure 2:
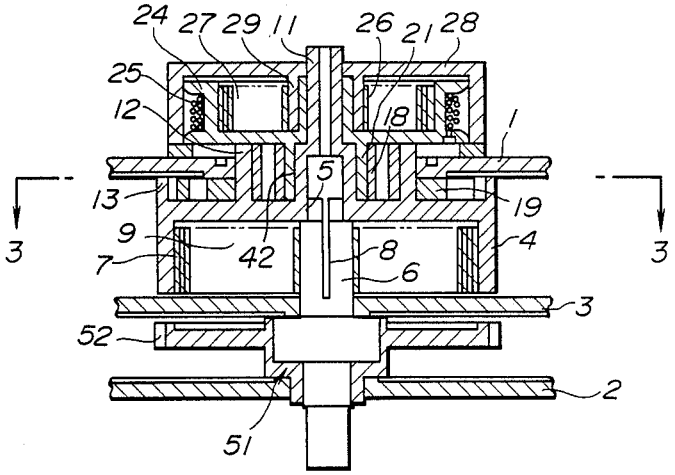
FIG. 2 is a cross-sectional view of the winding mechanism.
Figure 4:
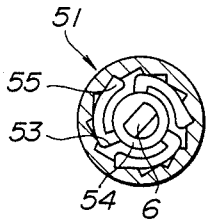
FIG. 4 is an explanatory view of a first gear ratchet mechanism.

In the drawings, reference numeral 1 and 2 designate right and left outer body housings, numeral 3 denotes a partition plate interposed between the right and left outer body housings 1 and 2, and numeral 4 depicts a power spiral spring case rotatably disposed in the body housings (FIG. 2). The case has a bore 5 at its center, and one end of a main shaft 6 rotatably supported to the partition plate 3 is inserted to the bore 5 of the case 4. A power spiral spring 7 is contained in a compartment 9 of the case 4. The spring 7 is connected at its outer end to the case 4 and at its inner end to the connecting groove 8 of the main shaft 6.

Figure 3:
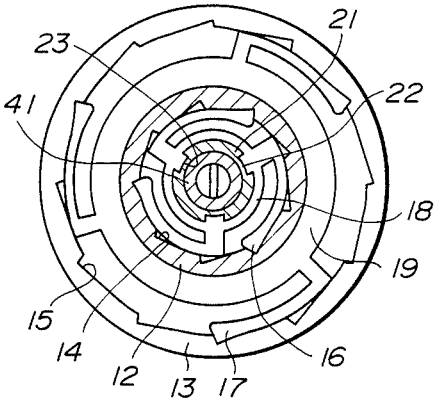
FIG. 3 is a sectional view taken along the line 3—3 of FIG. 2.

A winding shaft 11 projected externally is provided outside the bore 5 at the center of the case 4. Concentrically annular portions 12 and 13 on the case 4 are overlapped on the outer periphery of the winding shaft 11, and ratchets 14 and 15 are formed on the inner peripheral surfaces of both the annular portions 12 and 13 for transmitting the rotations of pawls 16 and 17 to the power spiral spring 7 in a winding direction (FIG. 3). Reference numerals 18 and 19 designate pawl rings respectively disposed in the pawls 16 and 17, the inner pawl ring 18 is connected to the winding shaft 11 to be described later, and the outer pawl ring 19 is fixed in the housing 1 around the inner annular portion 12. Numeral 21 denotes a winding ring barrel rotatably inserted to the base of the winding shaft 11, numeral 22 depicts a groove formed axially on the barrel 21, and numeral 23 indicates a strip of the inner ratchet ring 18 to be engaged with the groove 22. The barrel 21 and the inner pawl ring 18 always rotate together by the connection of the strip 23 to the groove. 22, and the outer pawl ring 19 allows rotation of ratchet 15 only in a predetermined direction when the power spiral spring 7 is wound up.

Figure 1:
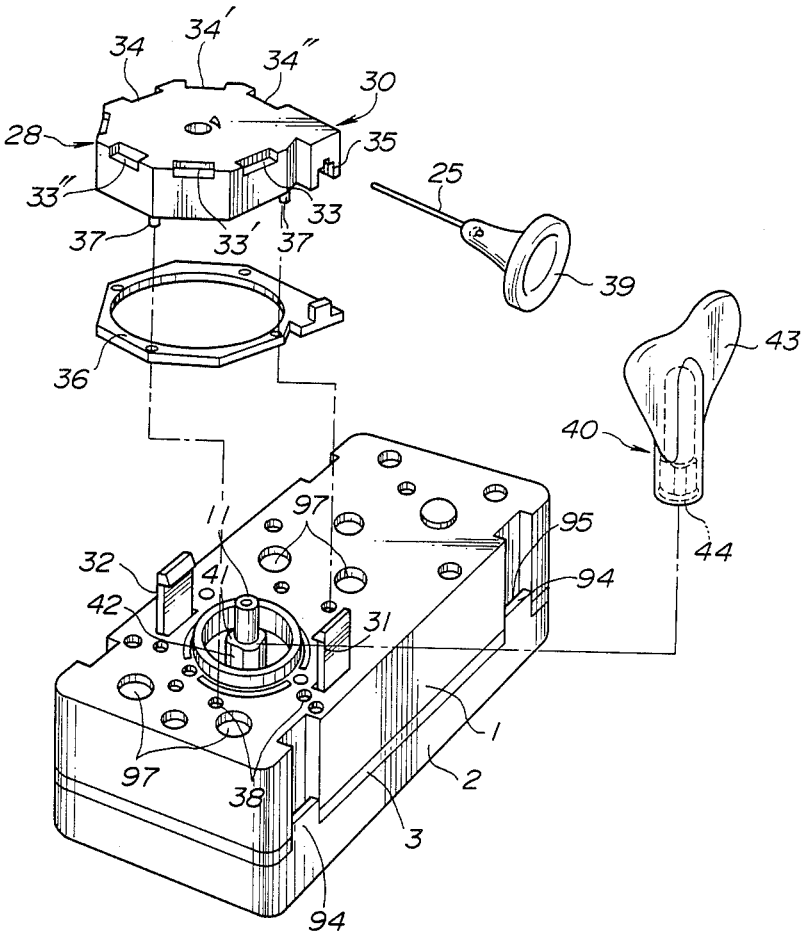
FIG. 1 is a perspective view of a winding mechanism of an embodiment of a spiral spring power source for a toy according to the present invention.

The winding ring 24 winds a winding cord 25 in the groove 22 on the barrel 21, contains a return spiral spring 27 in the space formed therein, and is connected to the winding shaft 11 by the barrel 21 and its extended portion 26. The return spiral spring 27 is connected at its outer end to the winding ring 24 and at its inner end to the shaft 29 of a winding ring case 28. The return spiral spring 27 is wound up by the rotation in the same direction as the spiral spring 7 by pulling the winding cord 25 for winding the power spiral spring 7. The return spiral spring 27 rotates the winding ring 24 to be released to return the winding cord 25 to the winding state. The winding ring case 28 is removable from the outer body housings together with the winding ring 24 (FIG. 1). In other words, the winding ring case 28 is mounted on the housings by connecting a pair of connecting hooks 31, 31 projected on the housings to a number of pairs of connecting steps 33, 34, . . . are formed on the outer surface of the case. In the embodiment described, above, three pairs of the connecting steps 33, 34, 33', 34', and 33'', 34'' are formed on the sides of the winding ring case 28 formed in an octagonal shape. Thus, the mounting positions can be altered at every 45° from the state in FIG. 1. Therefore, a cord drawing port 35 is moved to alter the pulling direction of the winding cord 25. Numeral 36 designates a spacer, numeral 37 denotes a connecting projection, numeral 38 depicts a connecting hole of the projection 37, and numeral 39 indicates a winding cord drawer.

The winding shaft 11 has a connecting portion 42 partially flattened on the peripheral surface of the base 41 thereof and so formed as not to connect the winding ring barrel 21 to allow it to freely rotate, but to connect the opponent 44 of a winding key 43 to the connecting portion 42 when the winding ring barrel 21 is removed so as to reliably wind the power spiral spring 7. Thus, two types of winding mechanisms 30 and 40 of the winding cord 25 and the winding key 43 are provided to be freely selected. Further, since the pulling direction can be also selected in case of the winding cord 25, the winding direction and method of the power spiral spring 7 can be freely selected, set and altered.

The main shaft 6 driven by the power spiral spring 7 is so provided as to be connected through a ratchet mechanism 51 to a first gear 52 only at the time of uncoiling the spiral spring. On the other hand, a toothed inner ratchet 53 for connecting in unidirectional rotation is formed on the central shaft of the first gear 52, and a pawl ring 54 is fixed to the main shaft 6. Numeral 55 designates a pawl. The first gear 52 is connected to an intermediate output member 59 through a gear set 50 of an acceleration unit having a second gear 56, a third gear 57 and a fourth gear 58. Further, the output finally produced is altered by a governor mechanism provided at the rear stage.

Figure 5:
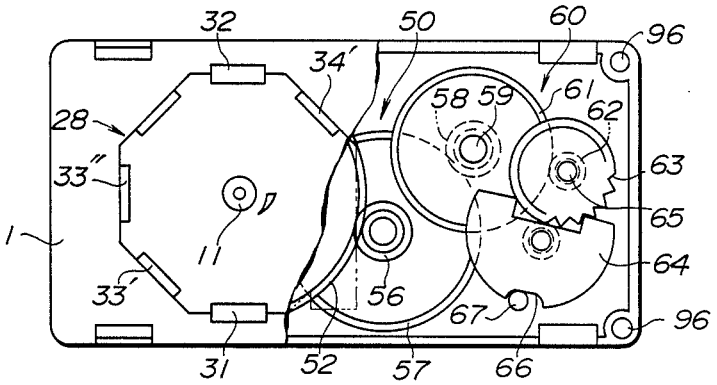
FIG. 5 is a left side view partly cut out showing the state that a first governor mechanism is associated.
Figure 6:
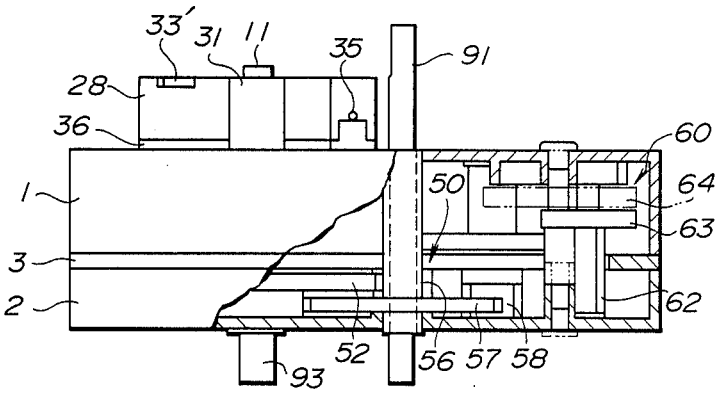
FIG. 6 is a plan view of the first governor mechanism.
Figure 8:
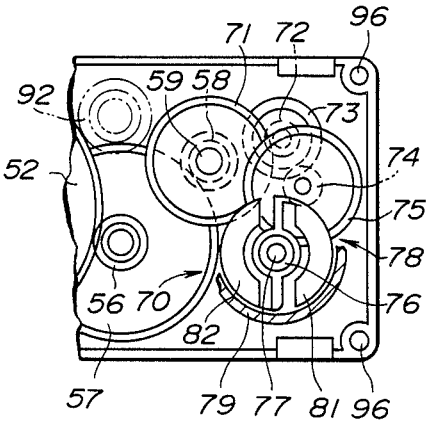
FIG. 8 is a side view of the inside of the governor mechanism.
Figure 7:
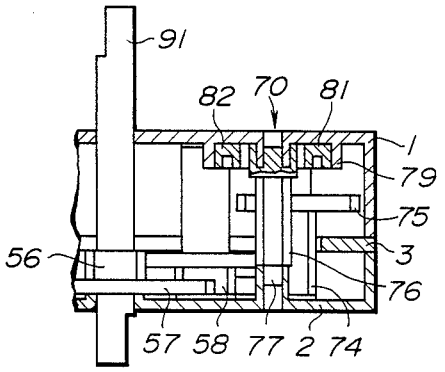
FIG. 7 is a cross-sectional plan view showing the state that a second governor mechanism is associated.

A first governor mechanism 60 has, as shown in FIGS. 5 and 6, a toothed wheel 63 rotated by intermediate gear sets 61, 62, and a second gear 64 engaged with the teeth of the toothed wheel 63 to apply a load thereto, thereby applying the rotation of a predetermined speed to an output shaft 65. Numeral 66 designates a cutout formed on the back of the second gear 64, and numeral 67 denotes a connecting pin to be connected to the cutout 66 to define the rocking range of the second gear 64. FIGS. 7 and 8 show a second governor mechanism 70. The second governor mechanism 70 has a governor 78 fixed to an output shaft 77 rotated through intermediate gear sets 71, 72, 73, 74, 75 and 76, and an arcuate wall 79 for surrounding the governor 78. When the movable arms 81, 82 of the governor 78 are externally extended by a centrifugal force, the governor 78 is slidably contacted with the inner wall to apply a resistance, thereby decelerating the output shaft.

Figure 10:
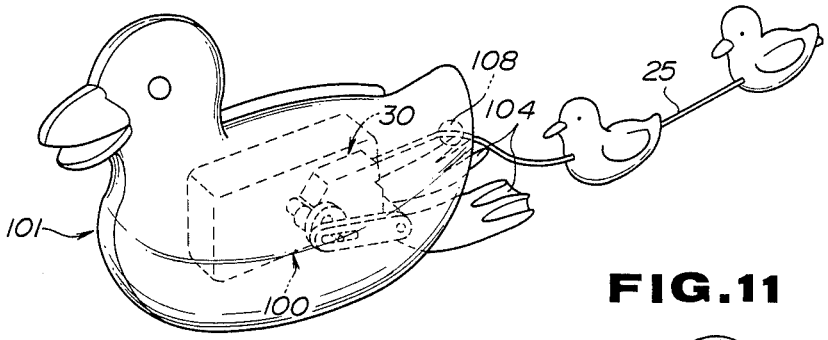
FIGS. 10 to 12 are perspective views showing examples of toys associated with the spiral spring power source according to the invention.
Figure 11:
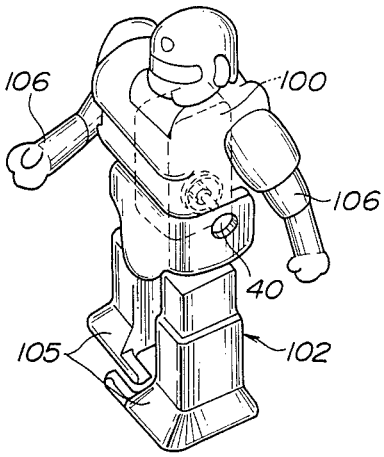
Figure 12:
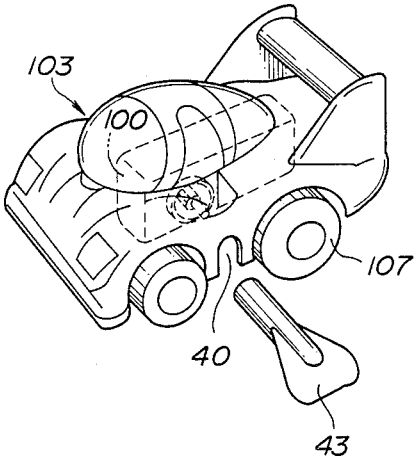

Reference numeral 91 designates an intermediate shaft extended externally from the third gear shaft, and numeral 92 denotes an intermediate gear engaged with the third gear 57 to be utilized to produce the output. The output shaft is provided in a bore 97 opened at a suitable position of the outer housing 1, and the gear formed on the output shaft is engaged with the gear of the gear set 50 of the acceleration unit to produce the output power. Numeral 93 indicates an extended portion of the main shaft 6 to be provided with an extended portion formed in the same manner as the connecting portion 42 of the winding shaft 11. Numeral 94 designates an outer housing connecting piece, numeral 95 denotes the connecting portion of the connecting piece 94, and numeral 96 depicts the holes of the connecting pin of the outer housings 1 and 2. FIGS. 10 to 12 show examples of toys employing the spiral spring power source 100 according to the invention. FIG. 10 shows an example of a toy 101 which travels in a floating manner with relatively high torque. FIG. 11 shows an example of a walking toy 103. FIG. 12 shows an example of a miniature car 103 with a high speed rotation. The power of the spiral spring power source is applied to a paddle 104, legs 105, arms 106, and wheels 107. Numeral 108 indicates a stopper of the winding cord 25.

In the spiral spring power source 100 constructed as described above, when the winding mechanism 30 of the winding yarn 25 is mounted in the state as shown in FIG. 1, the cord 16 and the ratchet 17 integral with the pawl 15 are rotated clockwise in FIG. 3 by pulling the winding cord 25. Thus, the power spiral spring 7 is wound up. When stopping pulling the winding yarn 25, the winding yarn 25 is returned to the winding ring 24 by the return spiral spring 27.

Figure 9:
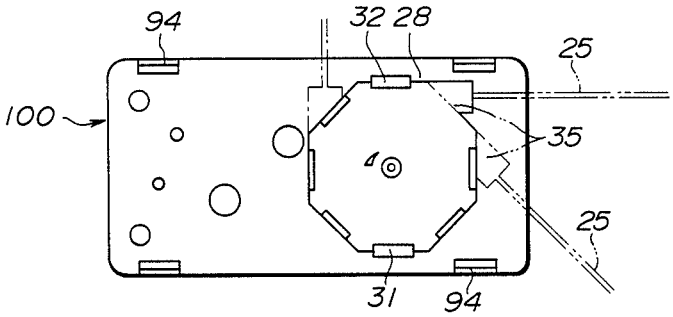
FIG. 9 is a left side view showing a modified example of a winding direction.

The power spiral spring 7 drives the intermediate output shaft 59 through the gear sets by uncoiling to drive the output shafts 65, 77 through the governor mechanisms 60 and 70 selected in advance. When employing the winding mechanism 30 of the winding cord 25, the direction of the cord drawing port 35 is switched by altering the mounting position of the winding ring case 28. Thus, the winding position can be selected without difficulty irrespective of the direction of the power source 100 (FIG. 9).

When the winding mechanism 40 of the winding key 43 is selected, the winding shaft 11 is directly to wind the power spiral spring 7 in the same manner as described above.

What is claimed is:

1. In combination with a power source for toys comprising a housing which includes therein a spiral power spring assembly, a wind-up shaft extending from the housing for winding up the spring assembly, and an output shaft connected with the spring assembly for rotation thereby when the spring assembly is released, a wind-up mechanism for the spring assembly comprising a wind-up casing, a winding ring journalled in the casing, a wind-up cord wound on the ring and having an outer end accessible through an opening in the casing for exerting a pull on the cord to rotate the ring, connector means in the casing for providing a drive connection between said ring and said wind-up shaft for rotating the shaft when the cord is progressively drawn through said opening in the casing, a spring return mechanism in the casing for rewinding the cord on the ring by rotation of the ring upon release of the cord, and releasable attachment means between the housing and the casing for selectively attaching the casing on the housing in different angular orientations of the casing relative to the housing and with said drive connection formed between the connector means and the wind-up shaft in each of said orientations whereby said cord can be drawn through said opening in different directions relative to said housing dependent on the selected orientation of the casing on the housing.

2. The invention as defined in claim 1 wherein said attachment means includes connecting hooks on the housing and an angular array of steps on the casing engageable selectively with said hooks for releasably holding the casing on the housing.

3. The invention of claim 2 wherein the casing is polygonally shaped with one of said steps on each side of the casing and wherein the hooks are oriented to engage opposite ones of said steps.

4. The invention as defined in claim 1 wherein the connector means includes ratchet means for releasing said drive connection when the ring is rotated to rewind the cord.

5. The invention as defined in claim 1 wherein the output shaft is connected to the spiral spring assembly through a gear train and ratchet mechanism, the ratchet mechanism disconnecting the output shaft from the spring mechanism when the wind-up shaft is rotated to wind the spring assembly.

* * * * *